US007658225B2

(12) United States Patent
Joki

(10) Patent No.: US 7,658,225 B2
(45) Date of Patent: Feb. 9, 2010

(54) POLISH ROD CLAMP APPARATUS

(75) Inventor: Glen Joki, Lloydminster (CA)

(73) Assignee: 1075878 Alberta Ltd., Lloydminster, Alberta (CA)

( * ) Notice: Subject to any disclaimer, the term of this patent is extended or adjusted under 35 U.S.C. 154(b) by 451 days.

(21) Appl. No.: 11/801,584

(22) Filed: May 10, 2007

(65) Prior Publication Data

US 2007/0295538 A1 Dec. 27, 2007

(30) Foreign Application Priority Data

May 10, 2006 (CA) ..... 2546208

(51) Int. Cl.
*E21B 19/02* (2006.01)

(52) U.S. Cl. ..... 166/75.14; 166/93.1; 166/241.2

(58) Field of Classification Search ..... 166/75.13, 166/75.14, 93.1, 241.1, 241.4; 279/56, 122, 279/124; 188/67
See application file for complete search history.

(56) References Cited

U.S. PATENT DOCUMENTS 1,117,241 A * 11/1914 Procunier ..... 279/56
2,137,853 A * 11/1938 Nixon ..... 384/16
2,173,355 A * 9/1939 Criswell ..... 188/67
3,083,025 A * 3/1963 Herbkersman ..... 279/122
3,475,798 A * 11/1969 Crickmer ..... 279/106
3,987,846 A * 10/1976 Thompson ..... 166/332.1
4,372,379 A 2/1983 Kulhanek et al.
4,716,961 A 1/1988 Makins, Jr. et al.
6,241,016 B1 6/2001 Dedels
6,457,958 B1 * 10/2002 Dunn ..... 418/1

OTHER PUBLICATIONS

Page from J. M. Huber Corporation showing No-bolt Polished Rod Clamp.

* cited by examiner

*Primary Examiner*—Jennifer H Gay
*Assistant Examiner*—Daniel P Stephenson
(74) *Attorney, Agent, or Firm*—Patterson, Thuente, Skaar & Christensen, P.A.

(57) ABSTRACT

A polish rod clamp apparatus has a body defining a lower rod aperture and a tapered body recess. A cap defines an upper rod aperture and a tapered cap recess. Tapered gripper dies have upper and lower outer surfaces sloping inward from a central portion and inner surfaces configured to bear against the polish rod. The dies are installed in the body recess such that inner surfaces bear against a polish rod and the lower outer surfaces bear against walls of the body recess. The dies are movable with respect to the body and are prevented from rotating. The cap is threaded onto the body such that the upper outer surfaces of the gripper dies bear against the walls of the tapered cap recess. Threading the cap onto the body forces the gripper dies against the outer surface of the polish rod passing through the body.

17 Claims, 2 Drawing Sheets

POLISH ROD CLAMP APPARATUS

RELATED APPLICATION

The present application claims priority to Canadian Application Serial No. 2,546,208 filed May 10, 2006, which is incorporated herein in its entirety by reference.

BACKGROUND OF THE INVENTION

It is known in the oil production industry to bring oil from underground formations to the surface using a rotary pump located downhole in the oil bearing formation and driven by a rotating rod string extending from a drive mechanism on the surface down through the well casing to the pump. Reciprocating pumps are also known where the rod string moved up and down by the drive instead of rotating.

Generally a polish rod clamp is clamped to a polish rod and a rotating or reciprocating drive is connected to the polish rod clamp such that the drive drives the polish rod clamp and thus the polish rod. The polish rod is essentially the top end of the rod string extending down to the pump such that driving the polish rod drives the pump.

Rotary drive mechanisms are disclosed for example in U.S. Pat. No. 6,241,016 to Dedels and U.S. Pat. No.4,716,961 to Makins, Jr. et al. The conventional polish rod clamp as illustrated in the mechanisms of Dedels and Makins. Jr. et al. typically comprises a pair of clamping members that clamp together by bolts extending lateral to the polish rod to clamp the polish rod between the clamping members.

U.S. Pat. No. 4,372,379 to Kulhanek et al. discloses a rotary drive mechanism supported above a well casing on a frame. The polish rod extends vertically upward through the middle of a rotating drive member and then a conventional rectangular polish rod clamp is clamped to the polish rod above the drive member. The bottom end of the polish rod clamp is engaged in the top of the drive member such that rotating the drive member rotates the polish rod clamp, the polish rod, the rod string, and the downhole pump. The weight of the rod string is supported on the drive member and frame.

Depending upon the length of the rod string from the surface to the pump, and the diameter of the rod string, and like factors with a rotary drive the top end of the rod string will typically rotate many times before the bottom end of the rod string, and thus the pump, begins to rotate. Rotary tension or torsion is thus present in the rod string during use. After stopping the rotary drive for service or like reasons, this torsion may be released by reversing the drive, or controlled by a brake or the like, however it is difficult to ensure that there is no torsion force being exerted between the polish rod and the drive through the polish rod damp. Releasing the clamping bolts on the polish rod thus can be hazardous.

FIELD OF THE INVENTION

This invention relates to oilfield equipment and in particular to a polish rod clamp for downhole oil well pumps.

SUMMARY OF THE INVENTION

It is an object of the present invention to provide a polish rod clamp apparatus that overcomes problems in the prior art.

In a first embodiment the present invention provides a polish rod clamp apparatus for attachment to a polish rod. The apparatus comprises a body defining a lower rod aperture in a bottom end thereof, and defining a tapered body recess with walls sloping inward toward the bottom end thereof. A cap defines an upper rod aperture in a top end thereof and defines a tapered cap recess with walls sloping inward toward the top end thereof. Threads are defined on lower inner walls of the cap and are configured to engage corresponding threads on an outer surface of the body. A plurality of tapered gripper dies, each has lower outer surfaces sloping inward from a central portion thereof and upper outer surfaces sloping inward from the central portion thereof, and has inner surfaces configured to bear against the polish rod. The tapered gripper dies are configured to be installed in the tapered body recess such that the inner surfaces of the gripper dies bear against an outer surface of a polish rod passing through the body, and the lower outer surfaces of the gripper dies bear against the walls of the tapered body recess. The gripper dies engage the body such that the gripper dies are movable up and down with respect to the body and such that the gripper dies are prevented from rotating with respect to the body. The cap can be threaded onto the body such that the upper outer surfaces of the gripper dies bear against the walls of the tapered cap recess. Threading the cap onto the body forces the gripper dies against the outer surface of the polish rod passing through the body.

In a second embodiment the present invention provides a polish rod drive apparatus for rotating a polish rod extending upward from a well. The apparatus comprises a rotating drive mechanism supported above the well such that the polish rod extending upward through a rotating drive member and upward through a polish rod clamp above the rotating drive member. The polish rod clamp comprises a body defining a lower rod aperture in a bottom end thereof, and defining a tapered body recess with walls sloping inward toward the bottom end thereof. A cap has threads defined on lower inner walls thereof engaging corresponding threads on an outer surface of the body. The cap defines an upper rod aperture in a top end thereof and defines a tapered cap recess with walls sloping inward toward the top end thereof. A plurality of tapered gripper dies each has lower outer surfaces bearing against the walls of the tapered body recess and has upper outer surfaces bearing against the walls of the tapered cap recess, and inner surfaces bearing against the polish rod. The gripper dies engage the body such that the gripper dies are movable up and down with respect to the body and such that the gripper dies are prevented from rotating with respect to the body. The body is engaged in the rotating drive member, such that the polish rod clamp and polish rod rotate with the rotating drive member.

The polish rod of the present invention is installed by sliding the body over the end of the polish rod, installing the gripper dies in the tapered recess around the polish rod, and then sliding the cap over the end of the polish rod and threading the cap onto the body and as the cap and the body move toward each other the gripper dies are forced inward and the inner faces thereof are forced against the outer surface of the polish rod and grip it securely. With tapered recesses and sloping walls at each end of the gripper dies, the dies are forced against the polish rod along substantially their entire length, improving grip on the polish rod. The gripper dies can conveniently be prevented from rotating with respect to the body by a no-turn pin extending inward from the body and engaging a corresponding groove in an outer surface of a gripper die.

The cap can be removed readily by unthreading it from the body, and raising the polish rod will release the gripper dies.

BRIEF DESCRIPTION OF THE DRAWINGS

While the invention is claimed in the concluding portions hereof, preferred embodiments are provided in the accompanying detailed description which may be best understood in conjunction with the accompanying diagrams where like parts in each of the several diagrams are labeled with like numbers, and where:

DETAILED DESCRIPTION OF THE DRAWINGS

Figure 1:
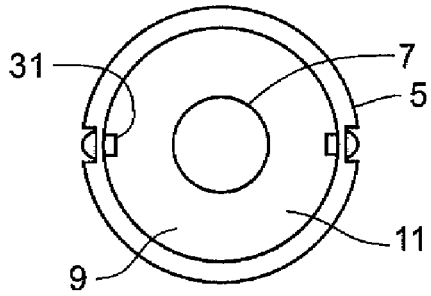
FIG. 1 is a top view of the body of an embodiment of the clamp apparatus of the invention.
Figure 2:
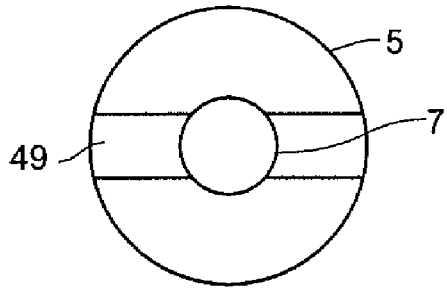
FIG. 2 is a bottom view of the body of FIG. 1.
Figure 3:
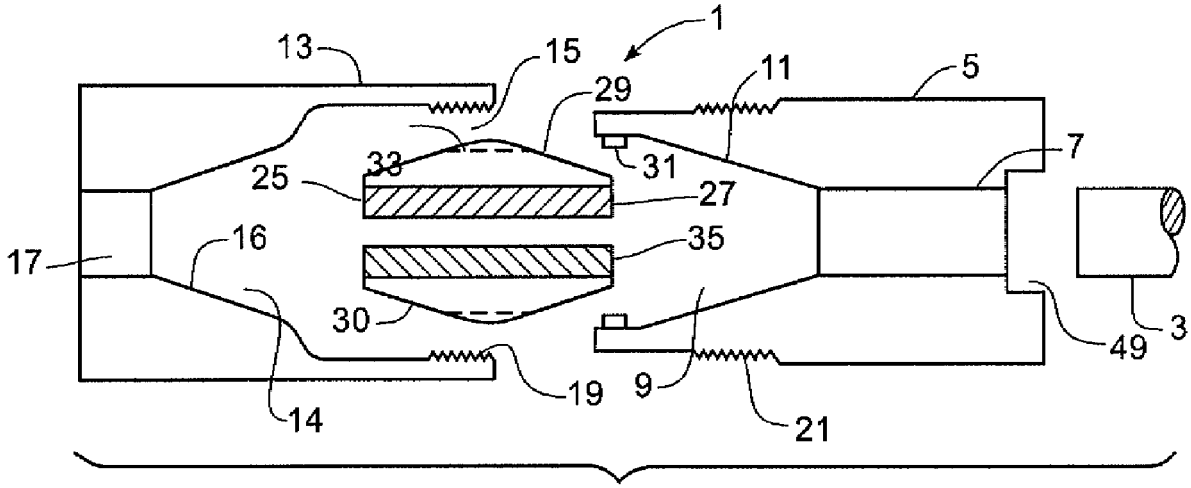
FIG. 3 is a schematic exploded side sectional view of the embodiment of the clamp apparatus.
Figure 4:
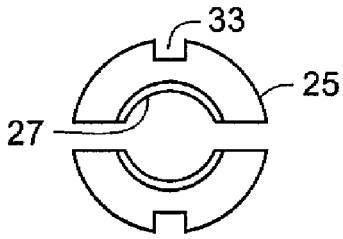
FIG. 4 is a top view of the gripper dies of the embodiment of FIG. 3.

FIGS. 1-5 illustrate a polish rod clamp apparatus 1 of the invention for attachment to a polish rod 3. The apparatus 1 comprises a body 5 defining a lower rod aperture 7 in a bottom end thereof, and defining a tapered, body recess 9 with walls 11 sloping inward toward the bottom end thereof. In the illustrated embodiment the body recess 9 is conical, and the conical walls 11 slope downward and inward generally from an upper portion of the body 5 to intersect the lower rod aperture 7 as shown. The conical shape is economical to provide, and serves the purpose well.

A cap 13 has an open bottom end 15 and defames an upper rod aperture 17 in a top end thereof and a tapered cap recess 14 with walls 16 sloping inward toward the top end thereof. In the illustrated embodiment the cap recess 14 is also conical, and the conical walls 16 slope inward generally from a lower portion of the cap 13 to intersect the upper rod aperture 17 as shown. The cap 13 defines threads 19 on lower inner walls thereof configured to engage corresponding threads 21 on an outer surface of the body 5.

A pair of tapered gripper dies 25 each has lower outer surfaces 29 sloping inward from a central portion thereof and upper outer surfaces 30 sloping inward from the central portion thereof and inner surfaces 27 configured to bear against the polish rod.

Figure 5:
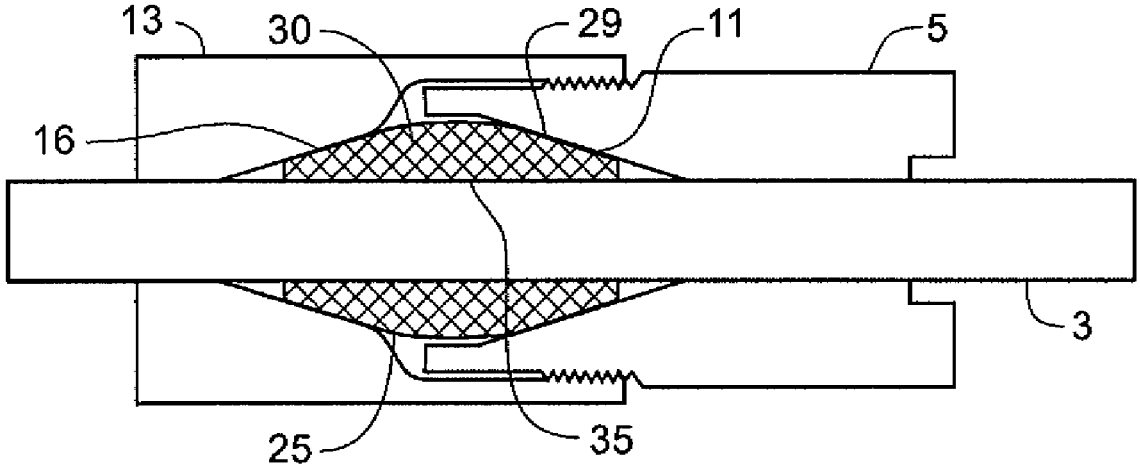
FIG. 5 is a schematic side sectional view of the embodiment of FIG. 3 installed on a polish rod.

The gripper dies 25 are configured to be installed in the tapered body recess 9 such that lower outer surfaces 29 of the gripper dies 25 bear against the walls 11 of the tapered body recess 9 and inner surfaces 27 of the gripper dies 25 bear against an outer surface of a polish rod 3 passing through the body as illustrated in FIG. 5. The cap 13 is threaded onto the body 5 such that the upper outer surfaces 30 of the gripper dies 25 bear against the walls 16 of the tapered cap recess 14. Threading the cap 13 onto the body 5 forces the gripper dies 25 against the outer surface of the polish rod 3 passing through the apparatus 1.

Although it is contemplated that other shapes would serve the required purpose, in the illustrated apparatus 1, the inner surfaces 27 of the gripper dies 25 are radiused the same as the polish rod 3, so as to substantially conform to the outer surface of the polish rod 3. Also in the illustrated apparatus 1, the upper and lower outer surfaces 30, 29 of the gripper dies 25 are tapered and conical such that the outer surfaces 30, 29 are substantially aligned with the sloping walls 16, 11 of the cap and body recesses 14, 9.

The gripper dies 25 engage the body 5 such that the gripper dies 25 are movable up and down with respect to the body 5 and such that the gripper dies 25 are prevented from rotating with respect to the body 5. Where the clamp apparatus 1 is used to rotatably drive a polish rod 3, preventing the dies 25 from rotating with respect to the body 5 prevents the dies 25 from slipping in the body 5 when the drive is activated.

In the illustrated apparatus 1, the gripper dies 25 are substantially prevented from rotating with respect to the body 5 by a no-turn pin 31 extending inward from an upper portion of the body 5 and engaging a corresponding groove 33 in an outer surface of an installed gripper die 25. A no-turn pin 31 is installed on each side of the body 5 to engage a groove 33 in each of the gripper dies 25.

The illustrated apparatus 1 uses a pair of gripper dies 25 however it is contemplated that a larger number of smaller gripper dies could be used as well. With a no-turn pin 31 engaged in each gripper die 25, each is secured with respect to the body 5, however it is contemplated that securing one die 25 would also prevent rotation of the gripper dies 25 with respect to the body 5 and could provide satisfactory operation in some applications.

The cap 13 is threaded onto the body 5 such that the upper outer surfaces 30 of the gripper dies 25 bear against the walls 16 of the tapered cap recess 14. Threading the cap 13 onto the body 5 forces the upper and lower outer surfaces 30, 29 of the gripper dies 25 along sloping walls 16 and 11 and thus the gripper dies 25 are forced inward. The whole length of the gripper dies 25 is forced against the outer surface of the polish rod 3 passing through the apparatus 1.

The clamp apparatus 1 can be used for a rotating or reciprocating pump drive, or like purposes. For example FIG. 6 schematically illustrates the polish rod clamp apparatus 1 used in a polish rod drive mechanism for rotating a polish rod 3 extending upward from a well 41.

Figure 6:
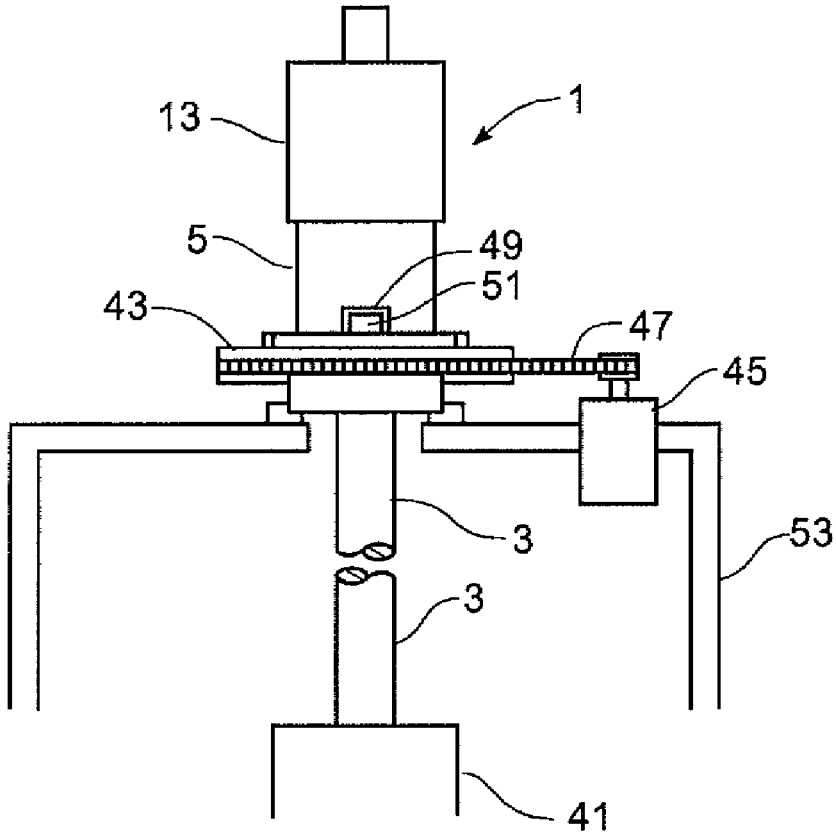
FIG. 6 is a schematic side view of the embodiment of FIG. 3 installed on a polish rod and incorporated into a rotating drive mechanism for rotating the polish rod.

In the system of FIG. 6, an outer portion of the body 5 is engaged in a rotating drive member illustrated as a sprocket 43 that. is rotated by a drive motor 45 and drive chain 47. The drive mechanism comprising sprocket 43 and motor 45 is supported on a stand 53 above the well 41. In the illustrated clamp apparatus 1 the bottom face of the body 5 defines a groove 49 configured to engage a lug 51 extending upward from the sprocket 43. Thus the polish rod clamp apparatus 1 and polish rod 3 rotate with the sprocket 43, and the stand 53 supports the drive mechanism and also the weight of the polish rod 3.

In the illustrated apparatus 1, the inner surfaces 27 of the gripper dies 25 define right and left helical threads 35 oriented to bear against the outer surface of the polish rod 3. Thus if the polish rod 3 turns with respect to the gripper dies 27, one of the dies will be drawn up and the other down, and thus will tend to lock against the polish rod 3.

The foregoing is considered as illustrative only of the principles of the invention. Further, since numerous changes and modifications will readily occur to those skilled in the art, it is not desired to limit the invention to the exact construction and operation shown and described, and accordingly, all such suitable changes or modifications in structure or operation which may be resorted to are intended to fall within the scope of the claimed invention.

While the invention is amenable to various modifications and alternative forms, specifics thereof have been shown by way of example in the drawings and will be described in detail. It should be understood, however, that the intention is not to limit the invention to the particular embodiments described. On the contrary, the intention is to cover all modifications, equivalents, and alternatives

What is claimed is:

1. A polish rod clamp apparatus for attachment to a polish rod, the apparatus comprising:

a body defining a lower rod aperture in a bottom end thereof, and defining a tapered body recess with walls sloping inward toward the bottom end thereof;

a cap defining an upper rod aperture in a top end thereof and defining a tapered cap recess with walls sloping inward toward the top end thereof;

threads defined on lower inner walls of the cap configured to engage corresponding threads on an outer surface of the body; and a plurality of tapered gripper dies, each die having lower outer surfaces sloping inward from a central portion thereof and upper outer surfaces sloping inward from the central portion thereof, and inner surfaces configured to bear against the polish rod;

wherein the tapered gripper dies are configured to be installed in the tapered body recess such that the inner surfaces of the gripper dies bear against an outer surface of a polish rod passing through the body, and the lower outer surfaces of the gripper dies bear against the walls of the tapered body recess;

wherein the gripper dies engage the body such that the gripper dies are movable up and down with respect to the body and such that the gripper dies are prevented from rotating with respect to the body;

wherein the cap can be threaded onto the body such that the upper outer surfaces of the gripper dies bear against the walls of the tapered cap recess; and wherein threading the cap onto the body forces the gripper dies against the outer surface of the polish rod passing through the body.

2. The apparatus of claim 1 wherein a slope of the upper and lower outer surfaces of the gripper dies is substantially the same as a slope of the walls of the corresponding tapered body and cap recesses.

3. The apparatus of claim 1 wherein the inner surfaces of the gripper dies substantially conform to the outer surface of the polish rod passing through the body.

4. The apparatus of claim 1 wherein at least one of the tapered body and cap recesses is conical.

5. The apparatus of claim 1 wherein the body is adapted at an outer portion thereof to engage a rotating drive mechanism.

6. The apparatus of claim 5 wherein a bottom face of the body defines a recess configured to engage the rotating drive mechanism.

7. The apparatus of claim 5 wherein the inner surfaces of the gripper dies define helical threads oriented to bear against the outer surface of the polish rod passing through the body and prevent the polish rod from rotating with respect to the gripper dies.

8. The apparatus of claim 7 wherein the helical threads on the inner surface of at least one gripper die are right hand and the helical threads on the inner surface of at least one other gripper die are left hand.

9. The apparatus of claim 1 wherein the gripper dies are prevented from rotating with respect to the body by a no-turn pin extending inward from the body and engaging a corresponding groove in an outer surface of an installed gripper die.

10. A polish rod drive apparatus for rotating a polish rod extending upward from a well, the apparatus comprising:

a rotating drive mechanism supported above the well such that the polish rod extends upward through a rotating drive member and upward through a polish rod clamp above the rotating drive member;

the polish rod clamp comprising:

a body defining a lower rod aperture in a bottom end thereof, and defining a tapered body recess with walls sloping inward toward the bottom end thereof;

a cap with threads defined on lower inner walls thereof engaging corresponding threads on an outer surface of the body, the cap defining an upper rod aperture in a top end thereof and defining a tapered cap recess with walls sloping inward toward the top end thereof; and a plurality of tapered gripper dies, each die having lower outer surfaces bearing against the walls of the tapered body recess and having upper outer surfaces bearing against the walls of the tapered cap recess, and inner surfaces bearing against the polish rod;

wherein the gripper dies engage the body such that the gripper dies are movable up and down with respect to the body and such that the gripper dies are prevented from rotating with respect to the body;

wherein the body is engaged in the rotating drive member, such that the polish rod clamp and polish rod rotate with the rotating drive member.

11. The apparatus of claim 10 wherein a slope of the upper and lower outer surfaces of the gripper dies is substantially the same as a slope of the walls of the corresponding tapered body and cap recesses.

12. The apparatus of claim 10 wherein the inner surfaces of the gripper dies substantially conform to the outer surface of the polish rod.

13. The apparatus of claim 10 wherein at least one of the tapered body and cap recesses is conical.

14. The apparatus of claim 10 wherein a bottom face of the body defines a recess configured to engage a ridge extending upward from the rotating drive member.

15. The apparatus of claim 10 wherein the inner surfaces of the gripper dies define helical threads oriented to bear against the outer surface of the polish rod and prevent the polish rod from rotating with respect to the gripper dies.

16. The apparatus of claim 15 wherein the helical threads on the inner surface of at least one gripper die are right hand and the helical threads on the inner surface of at least one other gripper die are left hand.

17. The apparatus of claim 10 wherein the gripper dies are prevented from rotating with respect to the body by a no-turn pin extending inward from the body and engaging a corresponding groove in an outer surface of a gripper die.

* * * * *